United States Patent [19]

Cleland

[11] 3,954,695

[45] May 4, 1976

[54] MOLDING COMPOSITION WITH RESIN COATED REFRACTORY

[75] Inventor: Robert L. Cleland, Albion, Mich.

[73] Assignee: Manley Bros. of Indiana, Inc., Chesterton, Ind.

[22] Filed: July 13, 1973

[21] Appl. No.: 378,917

[52] U.S. Cl. ..... 260/38; 260/DIG. 40

[51] Int. Cl.[2] ..... C08K 9/04

[58] Field of Search ..... 260/DIG. 40, 38

[56] References Cited

UNITED STATES PATENTS

| | | | |
|---|---|---|---|
| 3,632,785 | 1/1972 | Bornstein | 260/38 X |
| 3,692,733 | 9/1972 | Johnson | 260/DIG. 40 |
| 3,723,368 | 3/1973 | Brown et al. | 260/DIG. 40 |
| 3,816,145 | 6/1974 | Melcher | 260/DIG. 40 |

*Primary Examiner*—M. J. Welsh
*Assistant Examiner*—S. M. Person
*Attorney, Agent, or Firm*—Roy E. Petherbridge; Robert L. Lindgren; Edward D. Gilhooly

[57] ABSTRACT

An improved molding composition comprising a refractory sand, clay and water. The sand is coated with a thermo-plastic resin prior to being mixed with the other components of the composition.

7 Claims, No Drawings

MOLDING COMPOSITION WITH RESIN COATED REFRACTORY

BACKGROUND AND SUMMARY OF INVENTION

The present invention relates to particulate refractory minerals which constitute the basis of synthetic molding sand used in metal casting and more particularly to refractory minerals which contain at least 85% silica.

The particulate refractory minerals having a composition of at least 85% silica are commonly designated as lake, bank, sharp, and silica sands. These refractory minerals are used in green sand molds. Green sand molding compositions for use in casting generally comprise silica of a size range of from 50 to 180 mesh, and clay such as sodium or calcium bentonite in quantities from 4.0 to 12.0 per cent by weight of the silica and sufficient water to render the silica and bentonite mass plastic and workable.

In the manufacture of green sand molds, it is required to maintain a relatively high grain packing density and simultaneously to maintain as high a degree of uniformity in density across the casting face of the mold as possible. Also the productivity of the foundry is increased by the rapidity at which molds can be produced.

To achieve the required mold characteristics and at the same time increase productivity the foundry industry are using hydraulically operated molding machines. These machines are constructed to apply very high pressure to compact the molding sand in the flask and against the pattern.

While these hydraulic machines have greatly increased the production of molds, many problems have also been created which are peculiar to high pressure compaction. One of the primary difficulties relates to the surface finish of the casting. Also there is a gross penetration of the refractory in the casting surface and a high gas back pressure at the mold surface. These two latter conditions also tend to deteriorate the surface finish of the casting.

It is the primary object of the present invention to utilize the advantages associated with high pressure compaction molding machines while minimizing the disadvantages encountered heretofore.

This is accomplished generally by altering the surface characteritics of the refractory silicate grains with a very thin coating of thermo-plastic resin. The coated grains are subsequently mixed with bonding clay and water to form a molding composition. The molding composition including the thinly resin coated silicate has improved response to compaction pressure.

A further object is to provide a mold composition including the resin coated silicate grains which completely separates from the metal casting at shakeout thereby to substantially reduce casting cleaning costs.

A further object is to provide a mold composition which permits the use of finer grains of the silicate than normally permissable so that the finer grains enhance the smoothness of the casting.

Another object is the provision of mold composition which includes a minimum quantity of carbonaceous material so that fine carbon dust build-up in used sand is minimized thereby to permit the molding sand to be reused with no increase in amount of water above the original level.

Still another object is to provide a mold composition in which the bonding force of the clay such as bentonite is used more effectively so that the quantity of clay required may be reduced 20 to 25% below the levels commonly used in high pressure molding.

In the more specific aspects of the invention, the mold composition of the present invention comprises a particulate refractory mineral having a minimum $SiO_2$ content of 85% and a grain fineness number of 40–170 mesh, a bonding clay of about 1.5 to 8.0% by weight, and phenol formaldehyde thermoplastic resin of 0.5 to 5% by weight with sufficient water to render the entire mass plastic and moldable.

PREFERRED EMBODIMENT

The green mold composition of the present invention comprises generally a refractory grain, a resin for coating the refractory grain, clay and water.

The refractory grains may be selected from those generally used in foundry practice including silica, lake sand, zircon, olivine, and chromite sands alone or combinations thereof. The grain fineness number of the refractory varies between about 40 to 170 mesh according to the mass and pouring temperature of the alloy to be cast. Preferably the fineness number ranges between 50 to 160 mesh.

The thermoplastic resin with which the refractory grains are coated is selected from a group of resins having a high graphite yield range when heated above 1,600°F in a nonoxidizing atmosphere and are nonhygroscopic. Preferably, the thermoplastic resin has a graphite potential under the stated conditions sufficient to develop an electrically conductive structure in the coated sand mass, conductance of said sand mass being reciprocally stated at less than 400 ohms per cm. after the same mass has cooled from 1600° F to ambient temperature.

In practicing the present invention a resin found to be particularly suitable for coating the refractory is a phenol formaldehyde novolac having a mol ratio of formaldehyde to phenol as low as 0.5 to 1 and as high as 0.9 to 1.0. This aldehyde content is below the level that renders the resin thermosetting.

The clay used in the composition is preferrably either a sodium or calcium bentonite although a clay of the illite or kaolinite minerals may also be used. Suitable bentonite clays are the Black Hills sodium bentonite and Dixie Bond calcium bentonite both produced by International Minerals Corp., and Volclay sodium bentonite and Panther Creek southern bentonite both produced by American Colloid Co.

The thermoplastic resin is coated on the refractory grains prior to admixing with the bonding clay and water. The resin coating is applied to the grain by any of the well known coating processes as for example extraction from solution or heating.

The application of the resin to the refractory grain at any level of resin and on any of the above identified grains is preferrably accomplished by initially heating the refractory to a temperature from between 250° to 300° F. The resin is added to the heated refractory in a suitable mixer such as a pug mill or intensive muller. The heat of the sand is sufficient to melt the novolac flake and thereby cause it to flow over the grains in a uniform layer. The coated refractory grains are dry nontacky and free-flowing.

The coated refractory grain is then mixed with about 2.0 to 8.0 per cent by weight of bentonite. The mixture is plasticized with water in the amount of 40 to 50 per cent of the clay in a conventional mixing apparatus such as an intensive vertical or horizontal wheel muller.

Improved peel of the refractory from the casting is observed when using the mold composition including the coated refractory. Examination of the casting and mold after separation and upon cooling discloses that the mold surface is covered by a continuous layer of impalpably fine electrically conductive graphite. The graphite extends in decreasing concentration into the interstices of the mold. The graphite which is highly refractory forms a complete barrier between the mold refractory and the metal.

The mating face of the casting is covered with a very thin bluish gray film. The film is firmly bonded to the metal substrate but may easily be removed by conventional shot blasting or by a hydrochloric acid pickle. The film is chemically similar to mill scale or the coating formed on Russia iron, identified as $Fe_3O_4$.

In the following example typical formulations for the casting of several alloys and for various casting weights are given for illustration but are not to be considered as restrictive.

EXAMPLE I

| | Parts by weight |
|---|---|
| Dry silica sand | 93 |
| Thermoplastic resin | 1 |
| Bentonite clay | 4 |
| Water | 2 |

The dry silica sand has a grain fineness of 75 to 90 as determined by AFS methods. This composition is suitable for the production of iron and brass casting up to one inch cross section.

EXAMPLE II

| | Parts by weight |
|---|---|
| Dry silica sand | 87.5 |
| Thermoplastic resin | 2.0 |
| Bentonite clay | 2.0 |
| Kaolinite clay | 6.0 |
| Water | 2.5 |

The dry silica sand has a grain fineness of 52 to 70 as determined by AFS methods. This composition is suitable for the production of iron castings having cross sections of 1″ to 4″.

EXAMPLE III

| | Parts by weight |
|---|---|
| Dry silica sand | 91.5 – 92 |
| Thermoplastic resin | 1 |
| Bentonite clay | 5 |
| Water | 2.0 – 2.5 |

The dry silica sand has a grain fineness of 145 – 170. This composition is well suited to the production of iron, and aluminum and copper base alloy castings where the requirements for finish and close dimensional control are most stringent.

The effect of the resin coating on the strength and compaction of the molding composition is illustrated in the following comparison of a silica sand, grain fineness number 140, with and without the resin coating.

The coated sample was prepared in a National hot coater by discharging the same, preheated to 300° F. into the coater, adding 3 percent of a phenol formaldehyde thermoplastic resin having a mol ratio of 0.9 formaldehyde to 1.0 phenol, mixing said components until the resin has coated the silica grains, then discharging into conventional screening and cooling apparatus.

The uncoated sand sample was taken from the same lot of dried classified silica sand.

Thirty pound samples of the coated and the uncoated sands were mixed into molding compositions in a 24 LF high energy mixerr with 4.5% bentonite and plasticizing water. Each was tested at several moisture levels. The following data are typical of comparable moisture contents:

| | Coated | Uncoated |
|---|---|---|
| Moisture, percent | 1.94 | 1.86 |
| Permeability, units | 24 | 23 |
| Green Strength, psi | 36.4 | 29.3 |
| Specimen Wgt. grams | 162.3 | 153.2 |

The increase in green strength of 24% and in specimen weight of almost 6.0% clearly show the effect of the resin coating in achieving desirably high density and greater strength at the same packing energy.

More extensive representative data were compiled from tests on 2 batches of 70 grain fineness bank sand, one of which was coated with 3 percent phenol formaldehyde flake novolac having a mol ratio of 0.9 aldehyde to 1.0 phenol and the other, a control batch without resin coating. Both batches were bonded ina 24 LF mixer with 4.5 percent volclay sodium bentonite and water, and tested at 3 moisture levels. Results are shown below in Tables I, II and III.

TABLE I

| | % Water |
|---|---|
| Batch A (uncoated sand) | 1.60 |
| Batch B (uncoated sand) | 1.85 |
| Batch C (uncoated sand) | 2.20 |
| Batch D (coated sand) | 1.50 |
| Batch E (coated sand) | 1.85 |
| Batch F (coated sand) | 2.20 |

Standard AFS 2 × 2 inch specimens were prepared from each batch in the Dietert drop weight rammer. The properties obtained in the 3 ram weight rammer are tabulated in Table II.

TABLE II

| | Green Properties 3 RAM | | | | | |
|---|---|---|---|---|---|---|
| | Uncoated | | | Coated | | |
| | Sample A | Sample B | Sample C | Sample D | Sample E | Sample F |
| Compactability, % | 28.2 | 42.5 | 56.2 | 23.7 | 33.0 | 45.1 |
| Moldability Index | 98.4 | 84.5 | 46.5 | 99.9 | 96.1 | 92.2 |
| Density, lbs./cu. ft (165 grams) | 99.3 | 97.7 | 97.3 | 102.3 | 102.3 | 102.1 |
| Specimen Weight (2″ × 2″) grams | 164.5 | 161.5 | 161.2 | 169.4 | 169.4 | 168.9 |

TABLE II-continued

| | Green Properties 3 RAM Uncoated | | | Coated | | |
|---|---|---|---|---|---|---|
| | Sample A | Sample B | Sample C | Sample D | Sample E | Sample F |
| Permeability | 69 | 80 | 111 | 80 | 83 | 83 |
| Green Compression, psi. | 14.4 | 16.4 | 11.1 | 20.6 | 19.3 | 14.6 |
| Green Deformation, in./in. | .0133 | .0134 | 0.0143 | .0146 | .0176 | .0189 |
| Green Deformation, % | 1.33 | 1.34 | 1.43 | 1.46 | 1.76 | 1.89 |
| Dry Compression, psi. | 28 | 53 | 63 | 244 | 323 | 510 |
| Relative Deformation | 0.91 | 0.82 | 1.29 | 0.71 | 0.92 | 1.29 |
| Equivalent Squeeze Pressure Same weight as used for 3 Ram sample, psi. | 335 | 318 | 225 | 150 | 143 | 120 |

TABLE III

| | Green Properties Squeeze Tests Uncoated | | | Coated | | |
|---|---|---|---|---|---|---|
| | Batch A | Batch B | Batch C | Batch D | Batch E | Batch F |
| 100 PSI. SQUEEZE | | | | | | |
| Specimen Weight (2" × 2") grams. | 159.1 | 156.8 | 157.0 | 167.5 | 167.5 | 168.4 |
| Permeability | 80 | 94 | 131 | 85 | 82 | 75 |
| Green Compression, psi | 11.3 | 12.9 | 9.5 | 21.5 | 22.1 | 19.1 |
| Green Deformation, in./in. | .0120 | .0134 | .0146 | .0141 | .0174 | .0205 |
| Green Deformation,% | 1.20 | 1.34 | 1.46 | 1.41 | 1.74 | 2.05 |
| Relative Deformation | 1.06 | 1.04 | 1.54 | 0.66 | 0.89 | 1.07 |
| 150 PSI. SQUEEZE | | | | | | |
| Specimen Weight (2" × 2") grams. | 160.5 | 159.0 | 161.2 | 169.2 | 169.9 | 171.4 |
| Permeability | 76 | 87 | 111 | 76 | 71 | 65 |
| Green Compression, psi | 12.0 | 14.6 | 11.1 | 27.0 | 26.2 | 23.3 |
| Green Deformation, in./in. | .0131 | .0135 | .0143 | .0171 | .0201 | .0204 |
| Green Deformation, % | 1.31 | 1.35 | 1.43 | 1.71 | 2.01 | 2.04 |
| Relative Deformation | 1.09 | 0.91 | 1.29 | 0.64 | 0.77 | 0.87 |
| 200 PSI. SQUEEZE | | | | | | |
| Specimen Weight (2" × 2") grams. | 161.7 | 160.0 | 160.1 | 171.5 | 172.0 | 173.1 |
| Permeability | 73 | 83 | 113 | 69 | 66 | 61 |
| Green Compression, psi. | 13.1 | 15.2 | 11.1 | 30.4 | 30.2 | 23.9 |
| Green Deformation, in./in. | .0130 | .0141 | .0143 | .0182 | .0190 | .0203 |
| Green Deformation, % | 1.30 | 1.41 | 1.43 | 1.82 | 1.90 | 2.03 |
| Relative Deformation | 0.99 | 0.93 | 1.24 | 0.60 | 0.63 | 0.84 |

The sand mixes of Table I were squeezed at 100, 150, and 200 psi with a Dietert-Detroit No. 319-A Sand Squeezer. The weight of sand was adjusted to maintain a height of 2 inch at the desired squeeze pressure. The following properties were tabulated in Table III.

Table II compares the 3 ram properties of uncoated sand having varying percentages of moisture and 4.5% volclay and of the same characteristics converted to 3% thermoplastic coated sand at the same moisture percentage and clay.

At the various moisture levels coated sand does not feel as dry. Some have preferred to work it at 1.8 – 1.9%. The first significant comparison then is The Dietert Moldability index. For the uncoated sand the number is 46.0 which is reasonable for the clay:water ratio. The coated sand number is 92.5, a value ordinarily reached only by dry side sands.

This apparent dryness is confirmed in the compactability tests, where the lower value of 45 would indicate that the coated sand is considerably dried than the uncoated, value 56.

The differences between the two sands in the other tests tend to indicate that the coated sand is a much drier, stronger, denser packing sand. The only clear cut exception is the relative deformation. (Relative deformation = deformation × 1000 ÷ green compressive strength.) The determination is necessary to bring the time (strength) factor into the amount of deformation. Relative deformation is also an approximate measure of "wetness" of the sand. The coated sand shows relative deformation of 1.31 compared with 1.27 for the uncoated sand. The difference is not significant. The coated sand is definitely not dry.

On the basis of the three ram tests, the coated sand on the actual wet side behaves as the uncoated sand would at much lower actual moisture, except that it maintains that same deformation value, which the uncoated sand at much lower moisture could not.

Table III compares the two sands when the 2 inch specimens were prepared by squeezing at 100 psi, 150 psi, and 200 psi.

The specimen weight of the coated sand is heavier than the uncoated sand and is thus, more responsive to squeeze compaction than the uncoated sand.

This very definitely indicates that the coated sand is not dry, since dry side sand squeezes to lower density than heavy sands.

Additional tests at 150 and 200 psi confirm the results at 100 psi.

More importantly is that the uncoated sand specimen, Batch C rammed, weighs only 161.2 grams, and it takes 225. psi squeeze to reach this density level. The rammed coated specimen, Batch F weighs 168.9 grams, but it takes only 120 psi squeeze pressure to reach the same density.

Coated sand not only rams denser at the same clay and moisture levels; it squeezes down even better.

Most high pressure molding machines operated at upwards of 100 psi on the mold surface. Uncoated sand squeezed at that pressure is less dense than the three ram specimen.

Coated specimens squeezed at 100 psi are almost as dense as the three ram specimens. The advantages for high pressure molding are obvious. They would apply equally well on conventional jolt squeeze machines where pressures of 20 to 35 psi are employed.

What is claimed is:

1. A green molding composition comprising an admixture of clay, moisture and refractory grains precoated prior to admixture with said clay and mositure with a thermoplastic resin having a high graphite yield, said resin comprising between about 0.5 to 5.0% by weight of said composition.

2. The composition as defined in claim 1 wherein said thermoplastic resin comprises a resin which is non-hygroscopic.

3. The composition as defined in claim 2 wherein said refractory grains are selected from a group including silica, lake, bank, zircon, olivine and chromite sand having a grain fineness number ranging between about 40 to 180, and wherein said clay is selected from a group including sodium bentonite and calcium bentonite.

4. The composition as defined in claim 3 wherein said thermoplastic resin comprises a phenol formaldehyde flake novolac.

5. The composition as defined in claim 4 wherein said flake novolac has a mol ratio range between about 0.5 formaldehyde to 1.0 phenol and a mol ratio of 0.9 formaldehyde to 1.0 phenol.

6. The method of forming a green sand molding composition which comprises the steps of hot coating a thermoplastic resin having a high graphite yield on a refractory grain, drying said coated refractory grain such that it is non-tacky and free-flowing; and admixing said pre-coated refractory grain with a clay binder and water such that said resin comprises between about 0.5 and 5.0% by weight of said composition.

7. The method as defined in claim 6 wherein said hot coating comprises heating said refractory grains and mixing said resin with said heated refractory whereby said resin is melted and coated on said refractory.

* * * * *